US005685531A

United States Patent [19]

Auerbach et al.

[11] Patent Number: 5,685,531

[45] Date of Patent: Nov. 11, 1997

[54] PROCESS FOR ACCUMULATING UNFOLDED PAPER SHEETS AND COLLATING WITH FOLDED SHEETS

[75] Inventors: David R. Auerbach, West Redding; Joseph W. Guiles, Prospect; Michael A. Sapack, Southbury; Richard F. Stengl, Wolcott, all of Conn.

[73] Assignee: Pitney Bowes Inc., Stamford, Conn.

[21] Appl. No.: 712,719

[22] Filed: Sep. 12, 1996

[51] Int. Cl.[6] ..... B42C 1/10

[52] U.S. Cl. ..... 270/51; 270/52.12; 270/58.06

[58] Field of Search ..... 270/51, 52.12, 270/52.19, 52.2, 52.21, 52.22, 58.06

[56] References Cited

U.S. PATENT DOCUMENTS

| | | | |
|---|---|---|---|
| 4,138,101 | 2/1979 | Faltin | 270/52.19 |
| 5,104,104 | 4/1992 | Mol | 270/52.12 |
| 5,156,384 | 10/1992 | Donahue | 270/58.31 |
| 5,573,232 | 11/1996 | Ifkovits et al. | 270/51 |

*Primary Examiner*—John T. Kwon

*Attorney, Agent, or Firm*—Christopher J. Capelli; Robert H. Whisker; Melvin J. Scolnick

[57] ABSTRACT

A method of collating unfolded sheets of paper into a collation and combining the collation with a folded sheet of paper. The method comprises: feeding a plurality of unfolded sheets of paper seriatim along a feed path from an upstream position to a downstream position; conveying the unfolded sheets seriatim around a drum to cause the unfolded sheets to be conveyed to an upstream position; stopping the unfolded sheets seriatim in a pocket having a back panel and a top panel, the back panel stopping the unfolded sheets from being conveyed further upstream and forming a collation of the unfolded sheets; feeding a folded document having a leading folded edge from an upstream to a downstream position across the top panel on top of the collation of unfolded sheets, thereby forming a single stack of documents; and conveying the single stack of documents to a downstream location.

6 Claims, 5 Drawing Sheets

PROCESS FOR ACCUMULATING UNFOLDED PAPER SHEETS AND COLLATING WITH FOLDED SHEETS

BACKGROUND OF THE INVENTION

The instant invention relates to a method for accumulating unfolded sheets of paper and subsequently collating the accumulated sheets of unfolded paper with a folded sheet of paper, and more particularly to such a method wherein the unfolded sheets of paper comprise negotiable checks.

Inserting systems are well known for inserting a plurality of documents into a waiting envelope. Such systems typically insert a variety of documents, such as letters, cards, coupons, statements, bank checks, etc. which may or may not all be the same size. Obviously, the insertion process is less complex if the documents to be inserted are all the same size. However, this is rarely the case. In the case of bank statements which are mailed out by banks, the envelope typically contains a plurality of checks which are generally short in length and a printed statement which generally is folded and is longer, i.e. letter size, in length. Current, state of the art bank insertion systems feed the checks to a registration surface where the checks are collated, and then feed the folded statement on top of the check collation. Frequently the folded statement winds up between the checks because of the angle (not totally parallel to the collation) with which the statement approaches the collation, so that the checks become unregistered. The resultant, unregistered collation causes system jams and loss of operating time.

In view of the foregoing problem with state of the art bank insertion systems, the instant invention provides a system for feeding checks to a registration pocket and then combining the registered collation of checks with a folded statement so that the combining of the folded statement with the unfolded checks does not cause the registered collation of checks to become unregistered in any way.

SUMMARY OF THE INVENTION

Thus, the instant invention provides a method of collating unfolded sheets of paper into a collation and combining the collation with a folded sheet of paper. The method comprises: feeding a plurality of unfolded sheets of paper seriatim along a feed path from an upstream position to a downstream position; conveying the unfolded sheets seriatim around a drum to cause the unfolded sheets to be conveyed to an upstream position; stopping the unfolded sheets seriatim in a pocket having a back panel and a top panel, the back panel stopping the unfolded sheets from being conveyed further upstream and forming a collation of the unfolded sheets; feeding a folded document having a leading folded edge from an upstream to a downstream position across the top panel on top of the collation of unfolded sheets, thereby forming a single stack of documents; and conveying the single stack of documents to a downstream location.

DETAILED DESCRIPTION OF THE PREFERRED EMBODIMENT

Figure 1:
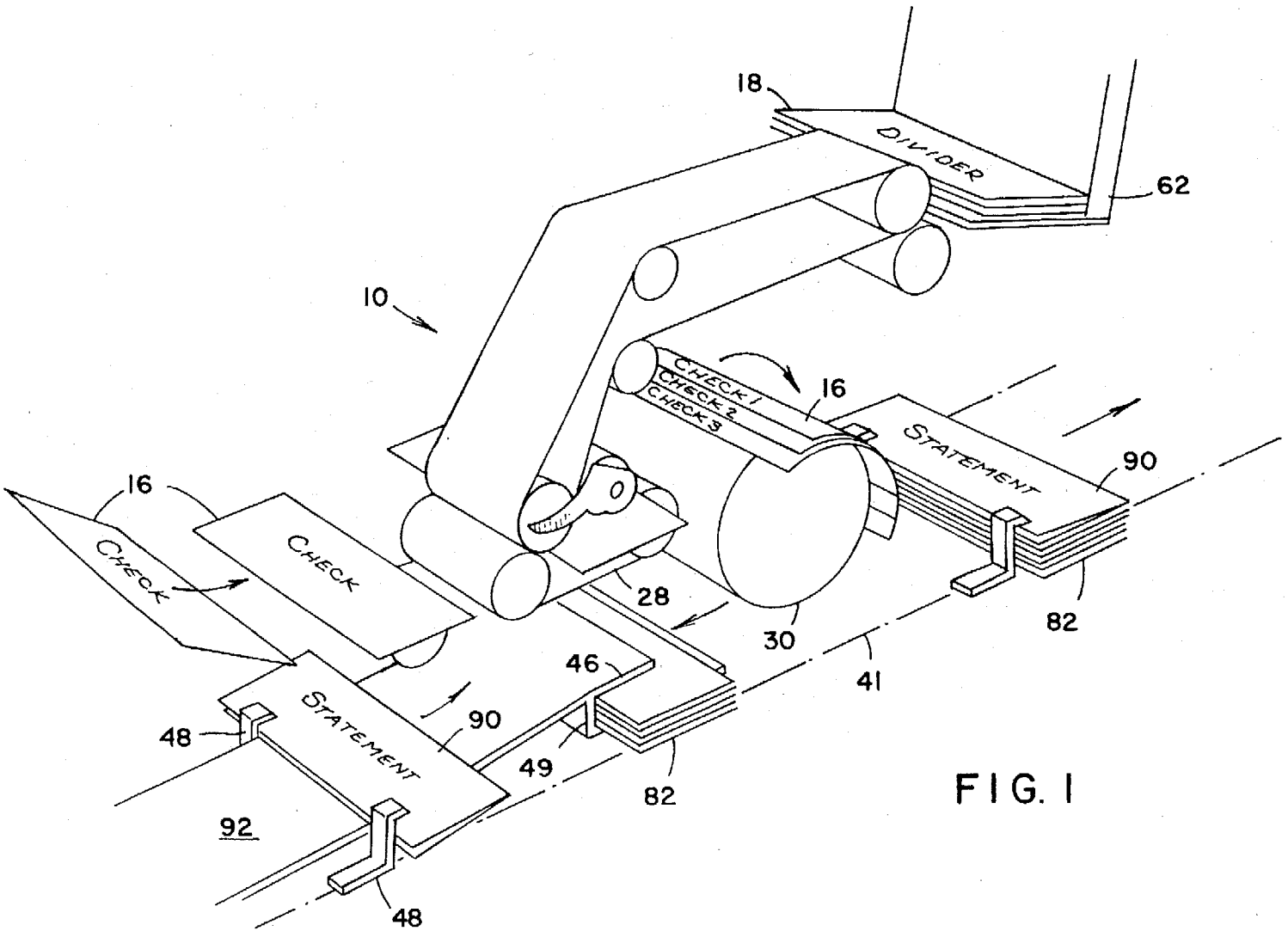
FIG. 1 is a perspective view of a method for feeding checks to a registration point and combining the collation of checks with a folded statement in accordance with the instant invention.
Figure 2:
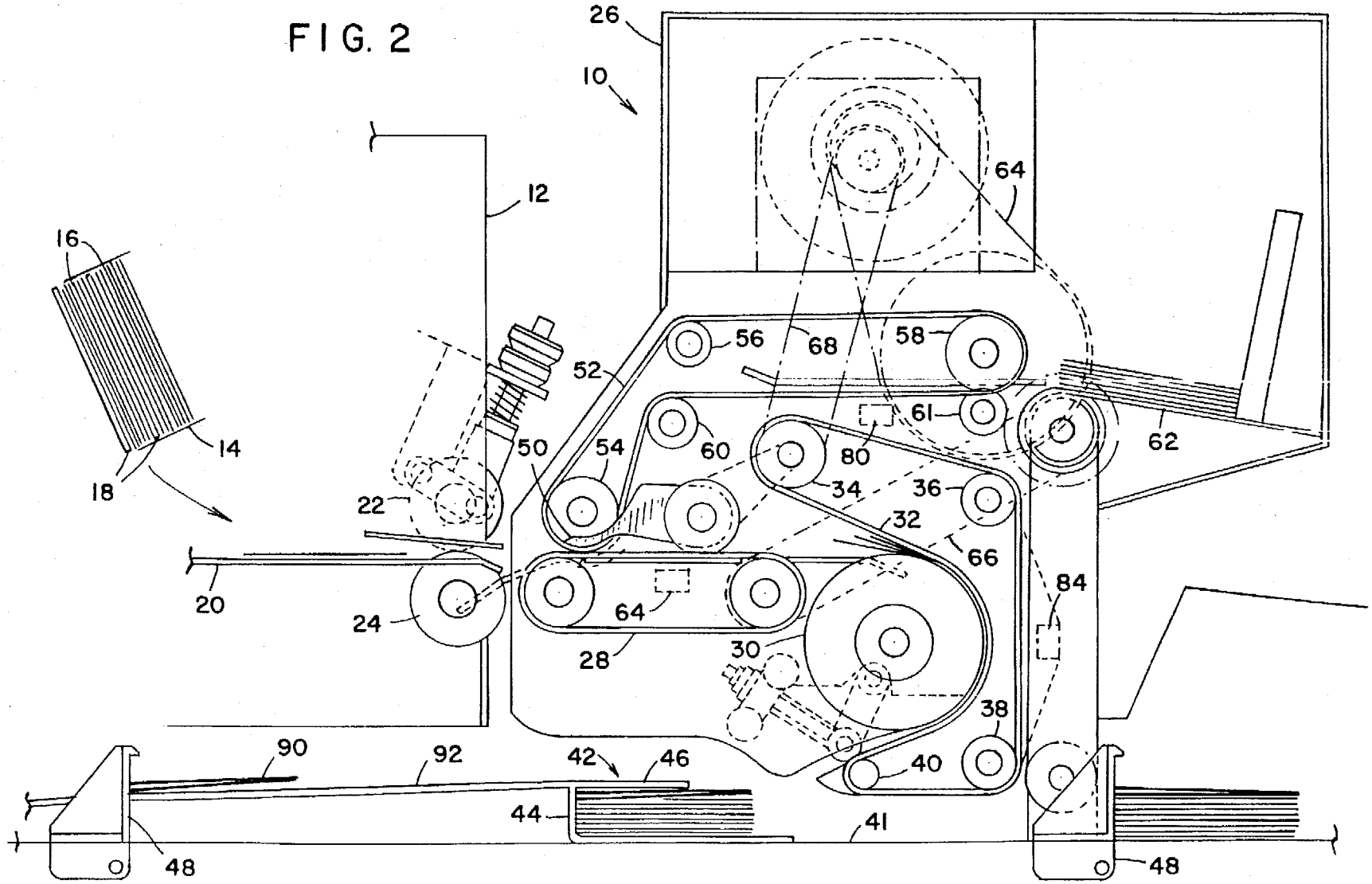
FIG. 2 is a side, elevational view of the method seen in FIG. 1.
Figure 3:
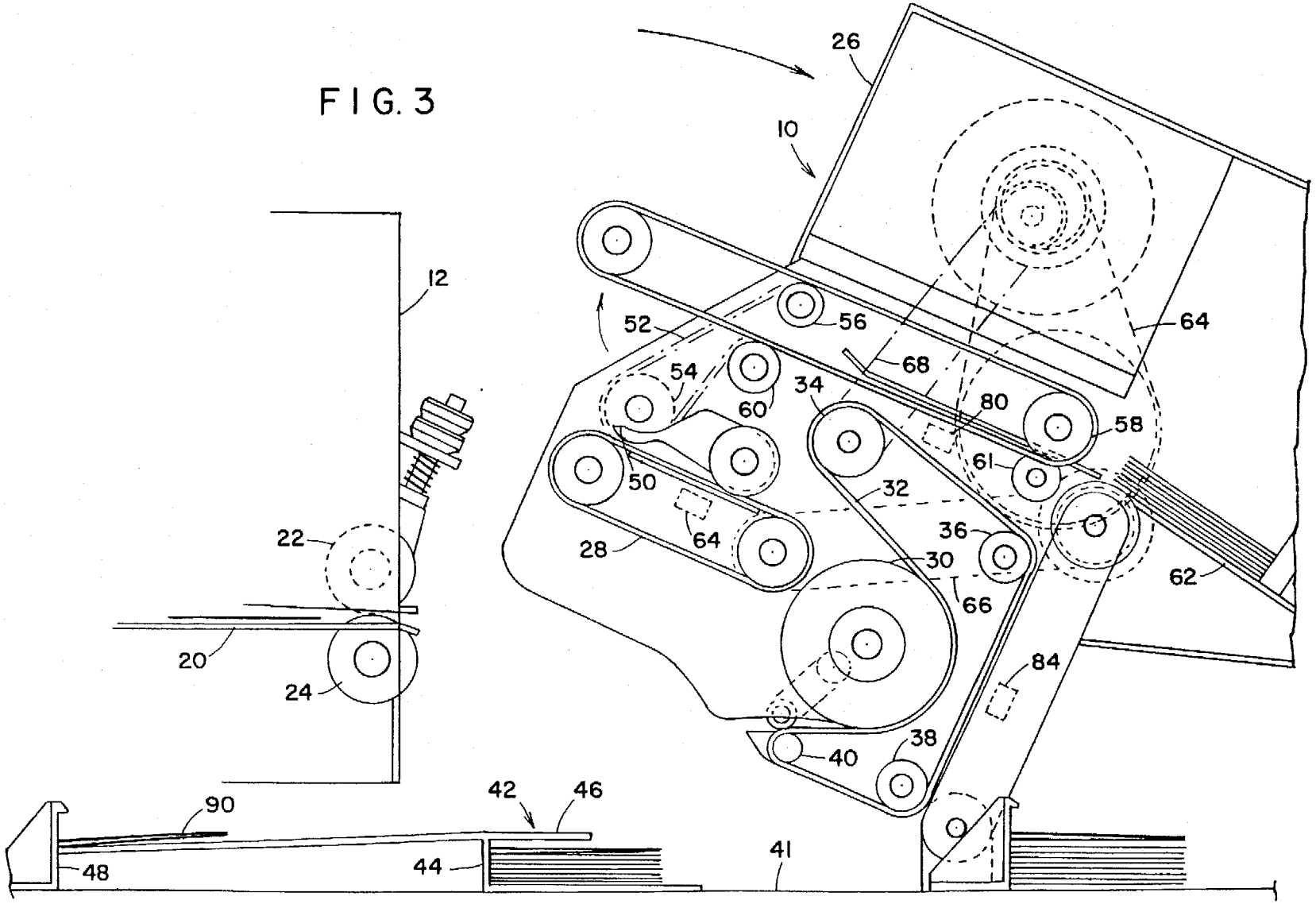
FIG. 3 is similar to FIG. 2, but shows the check feeding apparatus pivoted clockwise to facilitate jam clearance.

In describing the preferred embodiment of the instant invention, reference is made to the drawings, wherein there is seen in FIGS. 1–3 a check feeding and accumulating system generally designated 10 which would be employed by banks in mailing out monthly statements to customers. The check feeding and accumulating system 10 includes a check feeder 12 having a storage hopper 14 for storing a plurality of checks 16 and check dividers 18. Below the hopper 14 is a conveying deck 20 at the end of which are a pair of feed rollers 22 and 24.

Downstream of the check feeder 12 is a queue/divert module 26 having a continuously running conveyor belt 28 which leads to a queuing drum 30 and associated queuing belt 32. The belt 32 is rotatably mounted on the drum 30 and four rollers 34, 36, 38 and 40. Below the rollers 38 and 40 is the conveying deck 41. Below and upstream of the rollers 38 and 40 and located on the conveying deck 41 is a pocket 42 defined by a back panel 44 and a top panel 46. Cooperating with the conveying deck 41 are a plurality of pairs of pusher fingers 48. At the upstream end of and above the conveyor belt 28 are a plurality of diverting fingers 50.

Also at the upstream end of and above the conveying belt 28 is a diverting belt 52 rotatably mounted on five rollers 54, 56. 58, 60 and 61. Downstream of the diverting belt 52 and the roller 58 is a divider hopper 62.

Figure 4A:
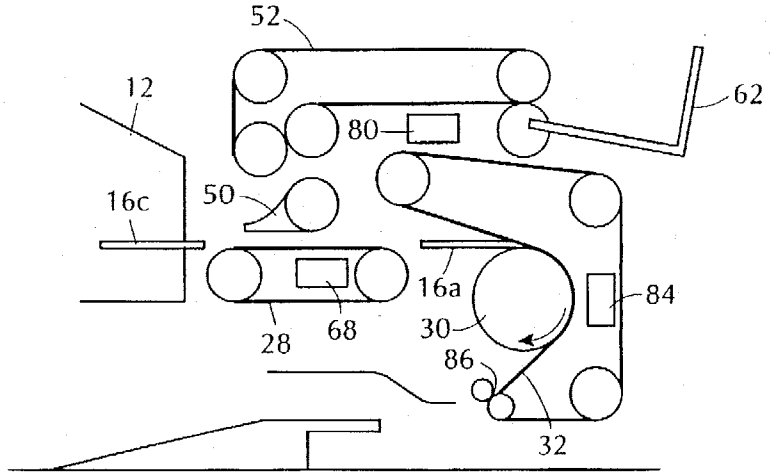
FIG. 4*a* is a schematic, side elevational view of the apparatus seen in FIG. 2 showing two checks being processed.

The operation of the check feeding and accumulating system 10 will now be explained. The diverting belt 52 and the conveyor belt 28 are continuously driven by drive belts 64 and 66 respectively. The queuing belt 32 is driven intermittently by drive belt 68 and an associated stepper motor (not shown). Checks 16 and check dividers 18 are fed by the check feeder 12 and enter the queue/divert module 26. Referring now to FIG. 4A, the diverter fingers 50 are elevated because the divert solenoid (not shown) has not been activated. A first check 16*a* has been conveyed under the diverter fingers 50 and along the conveyor belt 28 to arrive at the nip of the queuing drum 30 and queuing belt 32.

Figure 4B:
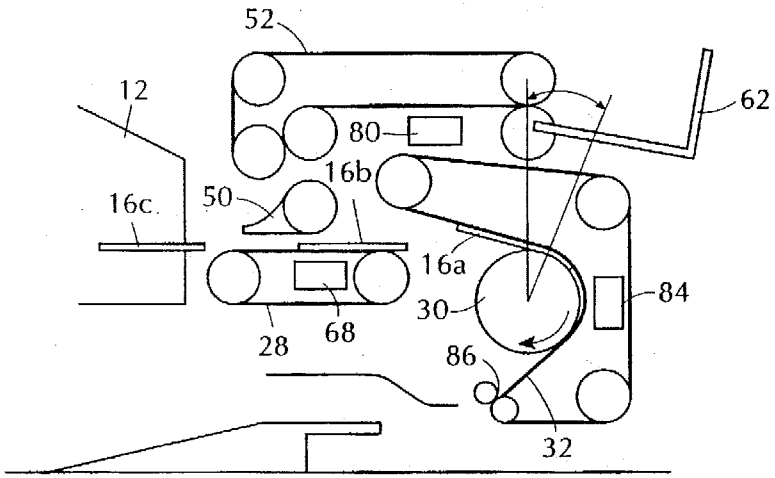
FIG. 4*b* is similar to FIG. 4*a*, but shows the first two checks further along the process and a third check entering the process.
Figure 4C:
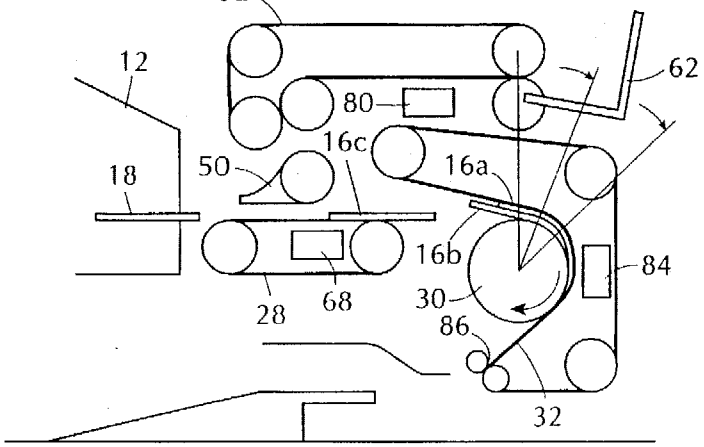
FIG. 4*c* is similar to FIG. 4*b*, but shows a shingled relationship between the first two checks and a check divider entering the process behind the third check.
Figure 4D:
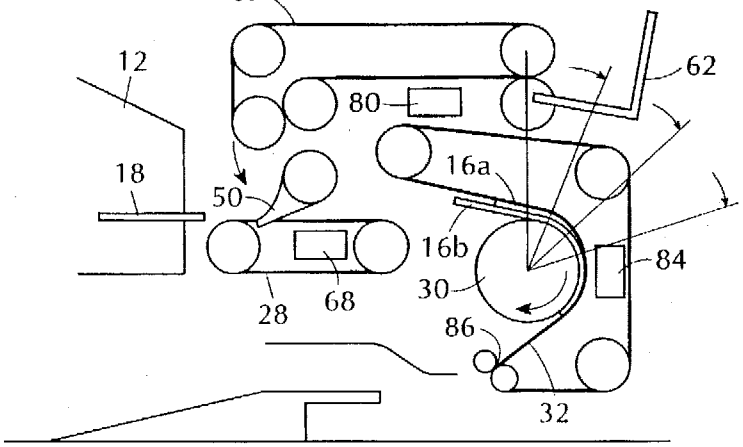
FIG. 4*d* is similar to FIG. 4*c*, but shows the three checks in shingled relationship and the diverter fingers pivoted downward.

A photocell sensor 68 detects the presence of the check 16*a* and this sensing event is used as a reference for the rotation of the queuing drum 30. As the first check 16*a* is captured by the queuing belt 32 at the position seen in FIG. 4A, the stepper motor is actuated, causing the queuing belt 32 and the drum 30, and consequently the first check 16*a*, to be incremented forward. Subsequent checks 16 are fed in and queued in the same manner, such that they overlap each other by a prescribed amount as they are wrapped around the queuing drum 30. Thus, FIG. 4B shows the first check 16*a* wrapping around the drum 30 while a second check 16*b* is about to enter the nip of the drum 30 and the belt 32 and a third check 16*c* is about to enter the conveyor belt 28. In FIG. 4C the second check 16*b* is wrapping around the queuing drum 30 and overlapping the first check 16*a* so that the two checks 16*a* and 16*b* are in a shingled relationship. The third check 16*c* is about to wrap around the drum 30 and a check divider 18 is about to exit the check feeder 12. FIG. 4D shows the diverting fingers 50 lowered by the diverting solenoid (not shown) and the third check 16*c* wrapping around the drum 30 and overlapping the second check 16*b*, so that the three checks 16*a–c* are now in shingled relationship to each other. In FIG. 4E the check divider 18 has been diverted by the diverting fingers 50 and is being conveyed by the diverting belt 52 toward the divider hopper 62. The presence of the divider 18 on the diverting belt 52 is detected by a photocell sensor 80 which ensures that the divider 18 has not jammed.

Figure 4F:
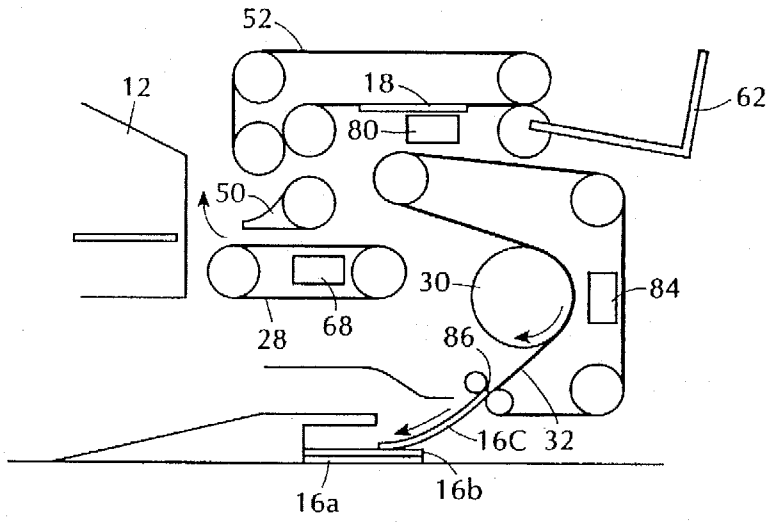
FIG. 4*f* is similar to FIG. 4*e*, but shows the checks entering the collation tray and the check divider about to enter a divider stacker.
Figure 4H:
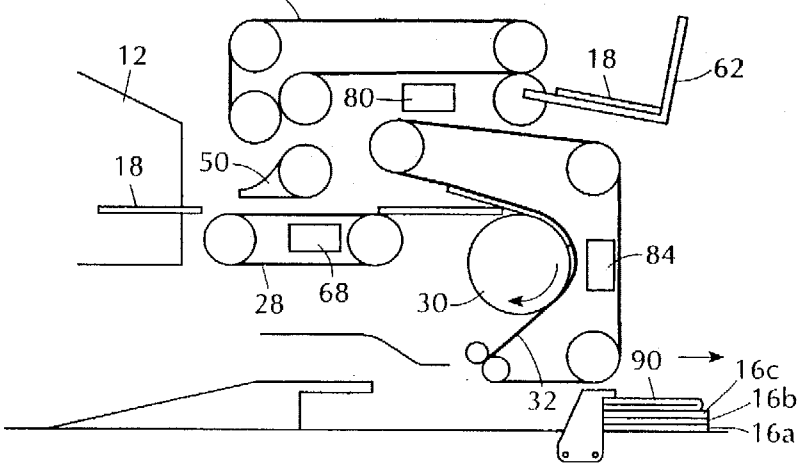
FIG. 4*h* is similar to FIG. 4*f*, but shows the pusher finger conveying the folded statement and the three collated checks downstream.
Figure 4E:
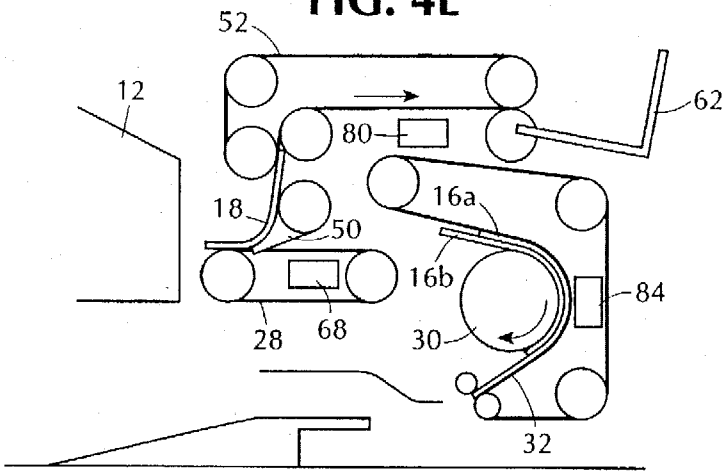
FIG. 4*e* is similar to FIG. 4*d* but shows the check divider being diverted from the path of the preceding checks by the diverter fingers.
Figure 4G:
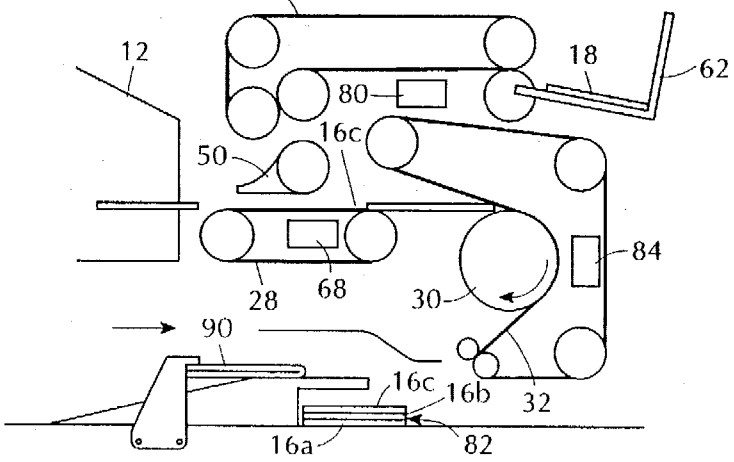
FIG. 4*g* is similar to FIG. 4*f*, but shows all three checks registered in the collation tray and a folded statement about to be deposited on top of the three collated checks by a pusher finger, and additional checks about to be processed.

Once the desired number of checks 16 are contained around the drum 30, the stepper motor (not shown) is commanded to perform a continuous motion in order to rotate the drum 30 and eject the queued checks, in this case checks 16*a–c*, upstream onto the conveying deck 41 as shown in FIG. 4F. At this point, the divider 18 is at the end of the diverter belt 52. The result of checks 16*a–c* being ejected onto the deck 41 is that the checks 16*a–c* are stacked in a single pile 82 against the tray back panel 44 on the deck 41, as seen in FIG. 4G, which also shows the divider 18 fed into the divider hopper 62. A photocell sensor 84 is used to detect the trail edge of the last check 16 in a given set, such as the trail edge 86 of the third check 16*c*. When the trail edge is detected, the queuing drum 30 is rotated a given amount in order to ensure that all checks 16 are fed completely out of the queue/divert module 26. The sensor 84 also senses the lead edge of the first check 16*a* for the purpose of stopping the shingling process when there are more checks 16 in a collation than the queuing drum 30 can accommodate. In this manner, the checks 16 are prevented from being struck by the pusher fingers 48 passing underneath.

The speed of the stepper motor motion profiles for the drum 30 is slaved to the speed of the check feeder 12 to which it is attached. A jog switch (not shown) is located on the queue/divert module 26 and is used to slowly rotate the queuing drum 30 forward and backward in order to clear jams in the module 26 as well as to check the basic operation of the module 26. FIG. 3 shows the queue/diverter module 26 rotated clockwise to facilitate jam clearance.

Referring again now to FIG. 4G, one of a pair of the pushers 48 is shown urging a half-folded statement 90 along a ramp 92 upstream of the conveying deck 41. As best seen in FIG. 1, the pushers 48 flank the ramp 90, which terminates at the upstream end of the top panel 46. The statement 90 originates in feeding apparatus upstream of the ramp 92 in conventional manner and need not be explained in any further detail. The pushers 48 pass through the openings in the pocket-forming tray 42 and initially deposit the statement 90 on top of the tray top panel 46; the forward progress of the pushers 48 causes the pushers 48 to then engage the check pile 82 and cause it to move forward with the statement 90 along the conveying deck 41. See FIG. 4H.

The foregoing description related to checks, but the instant invention is applicable to any situation in which it is desired to combine a folded document with a plurality of other documents which are short in the direction of travel. The folded statement 90 in the foregoing description is half folded, but clearly any number of folds could be imparted to the folded statement and the instant invention would be applicable.

While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A method of collating unfolded sheets of paper into a collation and combining said collation with a folded sheet of paper, comprising:

feeding a plurality of unfolded sheets of paper seriatim along a feed path from an upstream position to a downstream position;

conveying said unfolded sheets seriatim around a drum to cause said unfolded sheets to be conveyed to an upstream position;

stopping said unfolded sheets seriatim in a pocket having a back panel and a top panel, said back panel stopping said unfolded sheets from being conveyed further upstream and forming a collation of said unfolded sheet;

feeding a folded document having a leading folded edge from an upstream to a downstream position across said top panel on top of said collation of unfolded sheets, thereby forming a single stack of documents; and conveying said single stack of documents to a downstream location.

2. The method of claim 1, wherein said sheets are conveyed around said drum in shingled relationship.

3. The method of claim 2 wherein said unfolded sheets of paper include checks and check dividers.

4. The method of claim 3 wherein said folded sheet of paper is folded in half.

5. The method of claim 3, additionally comprising diverting said check dividers away from said drum.

6. The method of claim 2 wherein said drum is caused to intermittently start and stop to thereby cause said sheets to be conveyed around said drum in shingled relationship.

* * * * *